United States Patent [19]

Hayashi

[11] 4,342,571

[45] Aug. 3, 1982

[54] ELECTROSTATIC PRECIPITATOR

[75] Inventor: Tsutomu Hayashi, Yokohama, Japan

[73] Assignee: United McGill Corporation, Columbus, Ohio

[21] Appl. No.: 915,460

[22] Filed: Jun. 14, 1978

Related U.S. Application Data

[63] Continuation of Ser. No. 739,802, Nov. 8, 1976, abandoned, which is a continuation of Ser. No. 560,191, Mar. 20, 1975, abandoned.

[30] Foreign Application Priority Data

May 18, 1974 [JP] Japan ..... 49-50257

[51] Int. Cl.[3] ..... B03C 3/08

[52] U.S. Cl. ..... 55/137; 55/152

[58] Field of Search ..... 55/136–138, 55/152

[56] References Cited

U.S. PATENT DOCUMENTS

| | | | |
|---|---|---|---|
| 1,333,790 | 3/1920 | Bradley | 55/152 X |
| 2,195,431 | 4/1940 | Shively et al. | 55/152 X |
| 2,327,588 | 8/1943 | Bennett | 55/152 X |
| 3,181,285 | 5/1965 | Tepolt et al. | 55/138 |
| 3,704,572 | 12/1972 | Gourdine et al. | 55/154 X |
| 3,879,986 | 4/1975 | Sehmel | 55/152 X |

FOREIGN PATENT DOCUMENTS

| | | | |
|---|---|---|---|
| 966558 | 8/1964 | United Kingdom | 55/154 |

*Primary Examiner*—Kathleen J. Prunner

[57] ABSTRACT

An electrostatic precipitator comprising a plurality of flat plate dust-collecting electrodes, arranged in substantially equally spaced and parallel relationship with one another and each having a discharge electrode, or electrodes, on and along the edge of one side thereof with the discharge electrodes of the adjacent dust-collecting electrodes alternately facing in opposite directions; the edges having the discharge electrodes are arranged in a setback relation by some distance in relation to the nearby edges of the adjacent dust-collecting plates, where no discharge electrodes are provided, so that uniform and non-uniform electric fields may be produced.

11 Claims, 4 Drawing Figures

ELECTROSTATIC PRECIPITATOR

This is a continuation of application Ser. No. 739,802 filed Nov. 8, 1976, now abandoned, which is, in turn, a continuation of application Ser. No. 560,191 filed Mar. 20, 1975, now abandoned.

BACKGROUND OF THE INVENTION

The present invention relates to an electrostatic precipitator, more particularly, an electrostatic precipitator having a novel construction and capable of collecting dust particles having extremely high specific resistance as well.

Electrostatic precipitators, hereinafter called E.P., of prior-art construction have the disadvantage in that when dust particles have a resistivity of higher than $10^{11}$ Ω-cm, they cannot function owing to the back ionization taking place. Further disadvantages of the prior EP are as follows:

1. When the resistivity of dust particles is higher than $10^{11}$ Ω-cm, back ionization takes place in the layer of dust particles accumulated on the dust-collecting electrodes, causing the dust-collecting efficiency to decrease substantially so that it cannot function with practical efficiency. Two main reasons thereof are as follows: (a) The back ionization taking place in the layer of accumulated dust causes frequent spark discharges and as a result, the E.P. can no longer operate unless the applied voltage is made very low, giving rise to a substantial decrease of dust-collecting efficiency; (b) When the resistivity of the dust layer becomes higher further, the back ionization taking place in the layer of accumulated dust causes a large corona-discharge current to flow even at a low applied voltage. As a result, a large quantity of positive ions are generated from the layer of accumulated dust and a fairly large number of the negatively charged dust particles are changed over to positive charges by them. These positively charged dust particles are attracted toward the discharge electrodes, but since a strong electric wind is being discharged from the discharge electrodes, these positively charged dust particles are mostly not absorbed by the discharge electrodes, and almost all are re-charged to negative charges and move back to the dust-collecting electrodes, where these negatively charged dust particles are again recharged to positive by the positive ions generated by the back ionization. In this manner, these dust particles move back and forth between the respective dust-collecting and discharge electrodes, eventually going out from the stack without being collected.
2. The electric field generated between the discharge electrodes and dust-collecting electrodes is non-uniform throughout the E.P. from the inlet to the outlet, particularly in the vicinity of the discharge electrodes, where, strong electric winds are generated due to corona discharges, thereby producing eddy current winds in the dust-collecting space. As a result, the gas flow containing dust particles produces turbulent flow, greatly reducing the dust-collecting efficiency. Therefore, to enhance the dust-collecting efficiency, it is necessary to decrease the gas flow velocity and also to make the flow passage longer. As a result, it has heretofore been unavoidable that the E.P. become large in size.
3. Since the prior art E.P. must be large in size for the reason mentioned above, a larger space is necessary for the installation thereof, and the costs of such prior art E.P. manufacture and installation are unavoidably expensive.
4. Since dust particles are collected in electric fields, the layer of accumulated dust becomes non-uniform in thickness, and the undulating surfaces of the dust layer causes spark discharges to occur frequently.
5. Since the electric field is non-uniform, unnecessarily excessive corona discharges take place, consuming a substantial amount of unnecessary electric power.
6. Upon hammering the discharge electrodes, they are subjected to vigorous mechanical vibrations, therefore, the material fatigue due to the mechanical vibrations causes the discharge electrodes to break.
7. The fine dust particles released by rapping of the dust-collecting electrodes are liable to be reentrained in the gas flow due to the electric wind.

An object of the present invention is to provide a novel E.P. device, which is free from the above-described disadvantages of the prior-art E.P. and moreover is more advantageous in various other respects.

OBJECTS AND SUMMARY OF THE INVENTION

In light of the foregoing, the primary object of the present invention is to provide an E.P. capable of maintaining a high dust-collecting efficiency even when the resistivity of dusts is higher than $10^{11}$ Ω-cm.

Another object of the present invention is to provide an E.P. capable of not only having an excellent dust-collecting efficiency that is not effected by the occurrence of back ionization but also rather making use of the back ionization to increase the dust-collecting efficiency.

Still another object of the present invention is to provide an E.P. in which objectionable back ionization is prevented from occuring as much as possible.

Still another object of the present invention is to provide an E.P. which is small in size, easy to manufacture, less expensive, of lower power consumption, and higher in efficiency.

The foregoing objects of the present invention are accomplished in accordance with the present invention by designing an E.P. in such a manner that it comprises a plurality of flat-plate dust-collecting electrode, arranged in an equi-spaced and parallel relation with one another, each having discharge electrode or electrodes on and along the edge of one side thereof in such a manner that the discharge electrodes of the adjacent dust-collecting electrodes may alternately face in opposite directions, while the edges having discharge electrodes are arranged in a setback relation by some distance in relation to the near-by edges of the adjacent dust-collecting electrodes, where no discharge electrodes are provided, so that uniform and non-uniform electric fields may be produced. The E.P. thus composed has uniform and non-uniform electric fields, where in the non-uniform electric field the particles of dust are charged, whereas the dusts are collected mainly in the uniform electric field. The adjacent discharge electrodes are so arranged to face in opposite directions alternately so that upstream and downstream discharge electrodes relative to the gas flow are formed alternately, and the adjacent flat-plate dust-collecting electrodes are electrically connected alternately to the ground and high-voltage direct-current power supply so that negative-charging may take place with the upstream discharge electrodes and positive-charging may take place with the downstream discharge electrodes. The tips of the discharge electrodes may be directed in parallel with the adjacent flat-plate dust-collecting electrodes, however, to substantially reduce generation of back ionization one may direct the tips of discharge electrodes substantially perpendicular to the adjacent flat-plate dust-collecting electrodes.

DETAILED DESCRIPTION OF THE INVENTION

Figure 1:
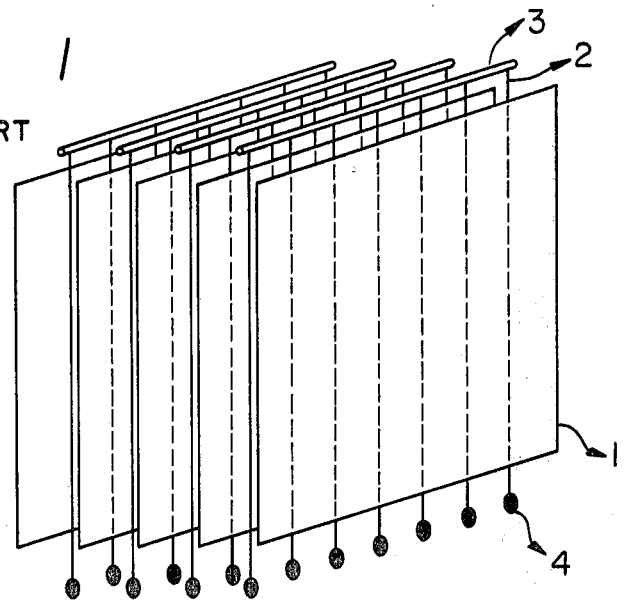
Fig. 1 PRIOR ART
FIG. 1 is a perspective view showing the fundamental construction of conventional prior art E.P.

The present invention will be better understood from the following detailed description and referring to the accompanying drawings wherein, for purposes of, for example, comparison, FIG. 1 illustrates a Prior Art electrostatic precipitator structure as having a plurality of spaced dust-collecting plates 1 and a plurality of electrode hang-bars 3 each of such hang-bars, in turn, supporting a plurality of downwardly depending electrodes 2 with each of such electrodes 2 being provided with, for example, suitable ceramic weights 4 in a manner as is well known in the art and as generally shown and disclosed in U.S. Pat. Nos. 1,391,436 and 1,801,515.

Figure 2:
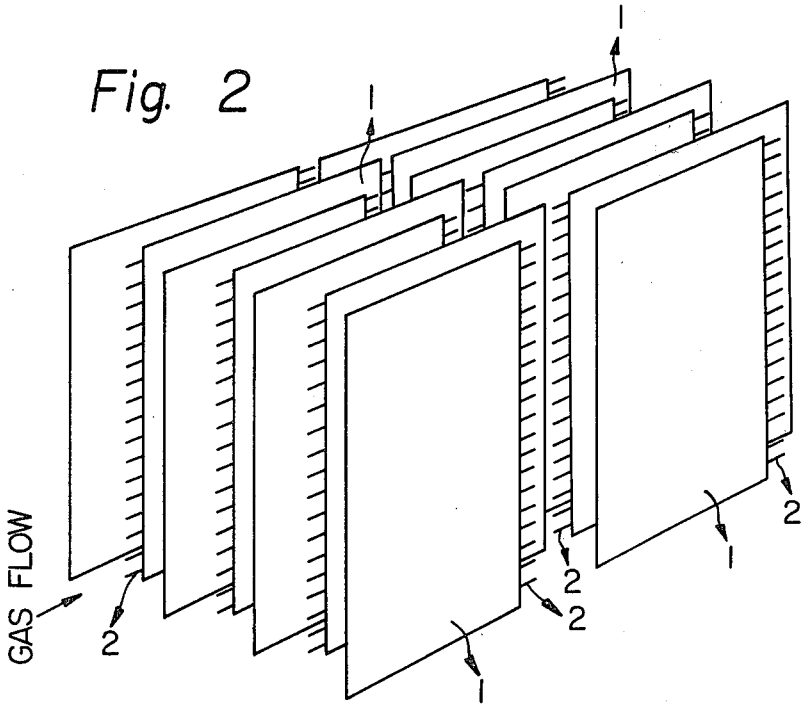
FIG. 2 is a perspective view showing the fundamental construction at the E.P. according to the present invention.
Figure 3:
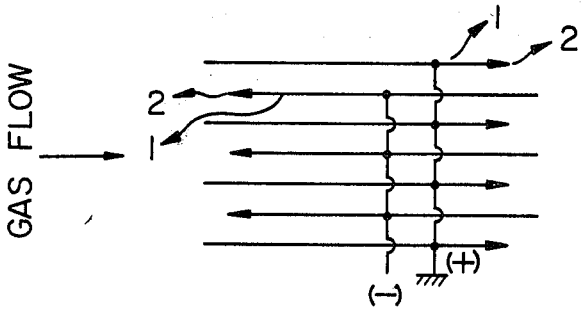
FIG. 3 is a circuit diagram simplified for easy understanding of the electrical connection of the construction shown in FIG. 2.
Figure 4:
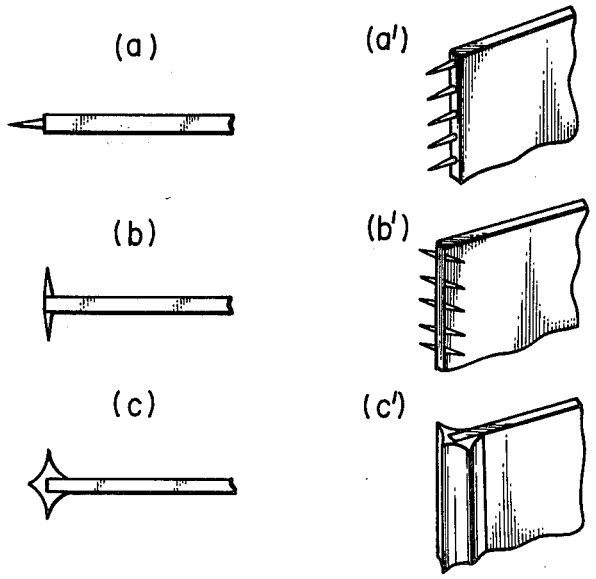
FIG. 4 is top and perspective views showing various preferable discharge electrodes to be used in the E.P. according to the present invention.

With reference to FIG. 2 showing the fundamental construction of the E.P. according to the present invention, each dust-collecting plate 1 is provided with discharge electrodes 2 on the straight edge of one side of such dust-collecting plate 1. A plurality of the dust-collecting plates 1 with discharge electrodes 2, all in the same shape and size, are arranged in parallel with one another with the adjacent discharge electrode edges facing in opposite directions alternately, while the discharge electrodes are positioned in a setback relation in relationship to the nearby edges of the adjacent dust-collecting plates where no discharge electrodes are provided as shown in FIG. 2. Referring to FIG. 3, which is a circuit diagram briefly illustrating the electrical connection of the construction shown in FIG. 2, alternate ones of the dust-collecting plates are connected together to form a first group which is electrically grounded while the other alternate ones are connected together to form a second group which is electrically connected with a source of high-voltage DC. Referring to FIG. 4, the dust-collecting plates 1 shown in FIG. 2 may have an aligned needle discharge electrodes as depicted, for example, at (a) and (a'), dual-needle discharge electrodes as depicted, for example, at (b) and (b'), or a one-piece double-edged discharge electrode as depicted, for example, at (c) and (c'). The needle-shaped discharge electrodes as at (a) or (b) may be mounted in an equi-spaced relation with one another. When use is made of needle-shaped electrodes, it is preferable that the spaces of the needle discharge electrodes are approximately equal, each having a distance substantially smaller than the distance between the two adjacent flat dust-collecting plates. It is also preferable that the needle discharge electrodes each have a diameter of approximately 5 mm and a tip with a maximum radius of approximately 0.5 mm.

The materials of the discharge electrodes and dust-collecting electrodes may be desirably selected depending on the kind and volume of the fluid from which dust is to be collected as well as of the substances contained therein; however, it is preferable to select, from the commercially available materials, such materials as best meeting the kind of dust as well as the conditions under which the intended dust collection is carried out.

FIGS. 2 and 3 illustrate preferred embodiments of the fundamental construction of the E.P. unit according to the present invention, and it is of course possible to fabricate a plurality of such units in series, in parallel, or in multi-stages depending on the conditions in which the dust collection is carried out.

Since the discharge electrodes are arranged in a setback relation by some distance in relation to the nearby edges of the adjacent dust-collecting plates as shown in FIGS. 2 and 3, non-uniform electric fields are formed between the needle or edge-shaped discharge electrodes (2) and the adjacent dust-collecting plates (1), so that corona discharge is generated from the tip ends of the respective discharge electrodes. In the area of this corona discharge, positive and negative ions are produced. The positive ions are attracted by the negative discharge electrodes or the negative dust-collecting plates immediately following these discharge electrodes, so that negative ions are contained in most parts of the passage in which the fluid flows. Most of the dust particles coming into the E.P. are, therefore, negatively charged and are attracted and collected by the dust-collecting plates which are grounded. On the other hand, positively charged dust particles, though small in number, tend to be attracted by the discharge electrodes; however, due to the electric wind from the discharge electrodes, these dust particles are not collected at where corona discharge is being generated but collected by the following ungrounded dust-collecting plates (negative).

In the prior-art E.P., dust particles adhere to the discharge electrodes in large quantity, so that the generation of corona discharge is largely obstructed, however, according to the present invention, collection of the dust particles on the places where corona discharge is being generated can be substantially prevented, giving rise to the advantage of eliminating the hammering of the discharge electrodes, which was indispensible to the prior-art E.P.

The reason why back ionization takes place is explained in that a potential drop equal to the product of the discharge current passing through the layer of accumulated dust and the resistivity of the dust is produced, and this potential drop causes the insulation of the dust to break down, resulting in localized ionization within the dust layer. Back ionization occurs when the relationship $i_c \times \rho > V_c$ is established, where $i_c$ is the density of the current flowing through the layer of dust, $\rho$ is the resistivity of the dust, and $V_c$ is the critical voltage at which the insulation of the dusts break down. Generation of back ionization is largely dependent upon the density of the current passing through the layer of collected dust, so that and if the current density $i_c$ is low, the threshold resistivity $\rho$ for occurrence of back ionization can become higher.

In the E.P. according to the present invention, the effective area of the discharge electrodes is small as compared with that of the discharge electrode of the prior art E.P., therefore, the E.P. according to the present invention has a lower $i_c$ and does not cause any back ionization to occur even at a value of $\rho$, at which back ionization occurs in the prior-art E.P. At such a high value as $10^{11}$ Ω-cm, such as for PbO or $PbSO_4$, however, back ionization may occur even in the E.P. according to the present invention. When back ionization occurs, some of the negatively charged dust particles which are being attracted to near the grounded dust-collecting plates (positive), charged positive by the many positive ions being produced by the back ionization, and are attracted back to the ungrounded dust-collecting plates (negative).

In the course of attraction to the negative dust-collecting plates, the positively charged dust particles are further and more strongly charged positive, because back-corona discharge is being generated in the terminal portion of a chamber of the E.P. unit, so that they will be surely collected by the negative dust-collecting plates. Thus, the E.P. according to the present invention has the advantage that the dust-collecting efficiency is not affected by occurrence of back ionization.

As stated in the foregoing, the present invention is based on a new idea of effectively utilizing back ionization, which is known to adversely affect the dust-collecting efficiency of E.P. of the prior art, in the improvement of dust-collecting efficiency. In the E.P. according to the present invention dust-ladden gas passes through negative and positive corona discharges alternately, so that it could be considered that the charges on the dust particles might be neutralized. However, the dust particles charged negative at first are almost all collected by the dust-collecting electrodes before the dust particles migrate to the area where the next opposite polarity corona discharge is available. Also, when particles of dust charged positively by the back ionization pass through the next positive corona discharge, they are further strongly charged with the same polarity so that there is very little fear of their becoming neutralized by the ions of opposite polarity. It has been proven through a number of experiments that the dust-collecting efficiency of the E.P. according to the present invention is excellent even when back ionization is occurring. This fact verifies the fact that the above explanation of the utilization of back ionization in E.P. of the present invention is correct.

Since the area where dust collection is effected according to the present invention has uniform electric field, the turbulent flow caused by the electric wind does not occur, such as in the case of the prior-art E.P., so that laminar flow can be maintained and thereby a remarkable improvement in collecting efficiency can be obtained; therefore, the E.P. according to the present invention has various advantages of improving the dust-collecting efficiency remarkably, permitting higher velocity of fluid flows, the size of E.P. to be smaller, and the costs of E.P construction to be much lower, as compared to the prior-art E.P.

Also, since dust collection takes place in the uniform electric field as mentioned above, the layer of collected dust particles is also uniform in thickness, resulting in decreased generation of spark discharge therein. In the E.P. according to the present invention, where it is designed to have such discharge electrodes as illustrated in (b) or (c), FIG. 4, due to smaller distances to the adjacent dust collecting electrodes, in which corona discharge takes place, generation of sparks can be much more lessened than that of the prior-art E.P. even under the conditions that owing to back ionization spark discharge is liable to occur in the layer of accumulated particles of dust. This prevents the applied voltage from being lowered due to the frequent occurrence of spark dischage caused by back ionization and, as the result, strong corona discharge can be maintained for charging particle of dust even when back ionization occurs, therefore, the dust-collecting efficiency is by no means affected thereby. Further, due to the uniform electric field available, reentrainment of dust upon rapping of the electrodes can be kept to a minimum, and also there is no adverse effect caused by mechanical vibration of the discharge electrodes.

In the E.P. according to the present invention, corona discharge takes place only in the area where particles of dust are being charged, and, no corona discharge takes place in the dust-collecting portion, so that the adverse effect of the electric wind generating turbulence in flow can be eliminated. Also, for the same reason, the present E.P consumes less electric power, necessitating only a small size high-voltage power source. Namely, the present E.P. is a very economical type E.P. and also an energy conservation type E.P.

The E.P. according to the present invention is so designed as to be suited for mass production because the E.P. consists of a plurality of dust-collecting plate units having the same shape and size, each with a discharge electrode or electrodes on the edge of one side of the plate. Furthermore, a plurality of same units may be manufactured on a mass production basis, the desired number of which can, if necessary, be combined in parallel and/or series with one another, depending on the volume and/or kind of the fluid to be subjected to dust collection. Thus the fabrication and installation of the E.P. are very simple and economical. Further, according to the present invention a plurality of dust-collecting plates of the same shape and size are assembled to comprise an E.P. unit, where they are arranged in an equi-spaced, parallel relation with one another, with the leading edges of alternate ones facing in one direction, while the other alternate ones facing in the opposite direction, therefore one can obtain the same dust-collecting effects and efficiency by flowing dust-ladden fluid in either direction. This makes it easy to select a place for installing the E.P. as desired, reducing the necessity of auxiliary construction work required for the E.P. installation.

As stated in the foregoing, the present invention provides an E.P. of a new system having various advantages as described above and capable of satisfactorily and economically collecting dust particles having such a high resistivity as cannot be collected by the prior-art E.P.

It should be noted that the embodiment as shown in FIG. 2 according to the present invention may be installed in multiple stages for treating a fluid stream, and that the amounts of positive and negative corona discharges are not necessarily equal to each other.

While the present invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An electrostatic precipitator for removing particles entrained in a fluid stream, comprising a plurality of flat-plate dust-collecting electrodes arranged in a generally uniformly spaced and parallel relationship as to be generally juxtaposed with one another to thereby define therebetween passage means for the flow of said fluid stream therethrough, a first of said flat-plate dust-collecting electrodes having an upstream edge for being situated relatively upstream to the flow of said fluid stream, said first flat-plate dust-collecting electrode also having a downstream edge for being situated relatively downstream to the flow of said fluid stream, a second of said flat-plate dust-collecting electrodes also having an upstream edge for being situated relatively upstream to the flow of said fluid stream, said second flat-plate dust-collecting electrode also having a downstream edge for being situated relatively downstream to the flow of said fluid stream, said first flat-plate dust-collecting electrode having said upstream edge thereof positioned at a distance further upstream than said upstream edge of said second flat-plate dust-collecting electrode, said first flat-plate dust-collecting electrode also having said downstream edge thereof positioned at a distance further upstream than said downstream edge of said second flat-plate dust-collecting electrode, first discharge electrode means of a first electrical polarity carried only along said downstream edge of said first flat-plate dust-collecting electrode and extending therefrom, and second discharge electrode means of a second electrical polarity opposite to said first electrical polarity carried only along said upstream edge of said second flat-plate dust-collecting electrode and extending therefrom thereby providing for the production of uniform and non-uniform electric fields, said first discharge electrode means comprising a projecting end portion projecting in a first direction from said first flat-plate dust-collecting electrode, and said second discharge electrode means comprising a projecting end portion projecting in a second direction from said second flat-plate dust-collecting electrode, said first direction and said second direction being generally opposite to each other, said upstream edge of said first flat-plate dust-collecting electrode and said downstream edge of said second flat-plate dust-collecting electrode being devoid of discharge electrode means, said upstream edge of said second flat-plate dust-collecting electrode being situated substantially closer to said upstream edge of said first flat-plate dust-collecting electrode than to said downstream edge of said first flat-plate dust-collecting electrode, said downstream edge of said first flat-plate dust-collecting electrode being situated substantially closer to said downstream edge of said second flat-plate dust-collecting electrode than to said upstream edge of said second flat-plate dust-collecting electrode, said first discharge electrode means projecting in said first direction a distance such that said projecting end portion of said first discharge electrode means terminates at a location upstream relative to the location of said downstream edge of said second flat-plate dust-collecting electrode, and said second discharge electrode means projecting in said second direction a distance such that said projecting end portion of said second discharge electrode means terminates at a location downstream relative to the location of said upstream edge of said first flat-plate dust-collecting electrode.

2. An electrostatic precipitator according to claim 1, wherein said plurality of flat-plate dust-collectlng electrodes comprises a first plurality of said first flat-plate dust-collecting electrodes and a second plurality of said second flat-plate dust-collecting electrodes, each of said first plurality of said first flat-plate dust-collecting electrodes being electrically connected together to thereby form a first group, each of said second plurality of said second flat-plate dust-collecting electrodes being electrically connected together to thereby form a second group, said first group being electrically grounded to thereby define first electrode assembly means of a first electrical polarity, and said second group being electrically connected to an associated source of relatively high voltage to thereby define second electrode assembly means of a second electrical polarity opposite to said first electrical polarity, each of said first plurality of said first flat-plate dust-collecting electrodes having said first discharge electrode means carried along the downstream edge thereof, each of said second plurality of said second flat-plate dust-collecting electrodes having said second discharge electrode means carried along the upstream edge thereof, said first and second plurality of said flat-plate dust-collecting electrodes being arranged in substantially equispaced and parallel relationship with one another in such a manner as to result in each of said first flat-plate dust-collecting electrodes being alternately arranged with respect to said second flat-plate dust-collecting electrodes.

3. An electrostatic precipitator according to claim 1, wherein each of said discharge electrode means carried by said plurality of said flat-plate dust-collecting electrodes comprise a plurality of needle-shaped electrode members which project in a direction generally parallel to the direction of flow of said fluid stream through said passage means.

4. An electrostatic precipitator according to claim 3, wherein the diameter of each of said needle-shaped electrode members is less than approximately 5.0 mm, and wherein the tip of each of said needle-shaped electrode members has a maximum radius of approximately 0.5 mm.

5. An electrostatic precipitator according to claim 3, wherein said electrode members are arranged as to be in substantially equally spaced relationship one to another along said edges on which said electrode members are carried, the distance between adjacent ones of said electrode members being less than the distance between adjacent ones of said first and second flat-plate dust-collecting electrodes.

6. An electrostatic precipitator according to claim 1, wherein each of said discharge electrode means carried by said plurality of said flat-plate dust-collecting electrodes project in a direction substantially normal to the direction of flow of said fluid stream through said passage means as to thereby result in such of said discharge electrode means carried by said first flat-plate dust-collecting electrode being substantially perpendicular to said second flat-plate dust-collecting electrode and as to thereby result in such of said discharge electrode means carried by said second flat-plate dust-collecting electrode being substantially perpendicular to said first flat-plate dust-collecting electrode.

7. An electrostatic precipitator according to claim 6, wherein said discharge electrode means comprise a plurality of needle-shaped electrode members.

8. An electrostatic precipitator according to claim 7, wherein the diameter of each of said needle-shaped electrode members is less than approximately 5.0 mm, and wherein the tip of each of said needle-shaped electrode members has a maximum radius of approximately 0.5 mm.

9. An electrostatic precipitator according to claim 7, wherein said electrode members are arranged as to be in substantially equally spaced relationship one to another along said edges on which said electrode members are carried, the distance between adjacent ones of said electrode members being less than the distance between adjacent ones of said first and second flat-plate dust-collecting electrodes.

10. An electrostatic precipitator according to claim 1, wherein each of said discharge electrode means comprises an elongated electrode member longitudinally extending along at least a substantial portion of said edge of such of said flat-plate dust-collecting electrodes on which said discharge electrode means is carried.

11. An electrostatic precipitator according to claim 10 wherein said elongated electrode member in a cross-sectional plane transverse to the longitudinal axis thereof has a configuration comprising first and second continuous electrode-member-edges extending in opposite directions away from and transverse to the plane of the flat-plate dust-collecting electrode carrying said elongated member, as to thereby have said first and second continuous electrode-member-edges as are carried by said first flat-plate dust-collecting electrode extending in directions falling within a plane substantially perpendicular to said second flat-plate dust-collecting electrode and as to thereby have said first and second continuous electrode-member-edges as are carried by said second flat-plate dust-collecting electrode extending in directions falling within a second plane substantially perpendicular to said first flat-plate dust-collecting electrode, and a third continuous electrode-member-edge extending in a direction away from but generally in the plane of the said flat-plate dust-collecting electrode carrying said elongated electrode member.

* * * * *